US005975940A

United States Patent [19]

Hartmann et al.

[11] Patent Number: 5,975,940

[45] Date of Patent: Nov. 2, 1999

[54] SELF-CLAMPING CONNECTORS FOR SINGLE-WIRED AND MULTI-WIRE CONDUCTORS

[75] Inventors: Frank Hartmann, Porta Westfalica; Hans-Josef Köllmann, Minden, both of Germany

[73] Assignee: WAGO Verwaltungsgesellschaft mbH, Minden, Germany

[21] Appl. No.: 08/993,070

[22] Filed: Dec. 18, 1997

[30] Foreign Application Priority Data

Dec. 20, 1996 [DE] Germany ..... 196 54 611

[51] Int. Cl.[6] ..... H01R 4/24

[52] U.S. Cl. ..... 439/441

[58] Field of Search ..... 439/441, 438, 439/440, 439, 436

[56] References Cited

U.S. PATENT DOCUMENTS

| | | | |
|---|---|---|---|
| 2,713,668 | 7/1955 | Gibilisco | 439/438 |
| 2,720,634 | 11/1955 | Hart | 439/441 |
| 4,036,545 | 7/1977 | Mysiak et al. | 439/395 |
| 4,133,595 | 1/1979 | Pritulsky | 439/441 |
| 4,397,514 | 8/1983 | Durand et al. | 439/436 |
| 4,673,232 | 6/1987 | Kubota et al. | 439/441 |
| 4,978,315 | 12/1990 | Edgley et al. | 439/441 |

FOREIGN PATENT DOCUMENTS

| | | | |
|---|---|---|---|
| 0097378 | 4/1989 | Japan | 439/441 |
| 0161681 | 6/1989 | Japan | 439/441 |
| 2204748 | 11/1988 | United Kingdom | 439/441 |

*Primary Examiner*—Steven L. Stephan
*Assistant Examiner*—Michael C. Zarroli
*Attorney, Agent, or Firm*—Salter & Michaelson

[57] ABSTRACT

The invention concerns a self-clamping connector for single-wire or multi-wire electrical conductors. It includes a spring loaded clamp; with one or more leaf springs and a corner-angle conductive core with eccentric slots, in which leaf springs with a larger loop shape with a greater effective length are used to contact an inserted conductor.

3 Claims, 1 Drawing Sheet

SELF-CLAMPING CONNECTORS FOR SINGLE-WIRED AND MULTI-WIRE CONDUCTORS

BACKGROUND AND SUMMARY OF THE INVENTION

The invention concerns a self-clamping connector.

Clamping connectors are known from U.S. Pat. No. 4,397,514. In the connector presented in the named U.S. Patent, the effective length of the leaf springs corresponds approximately to the diagonally measured distance between the guide-member leg and the contact leg of the conductive core piece. If a "soft" spring characteristic is to be obtained with this known clamping connector, as is necessary for inserting multi-wire and particularly fine-wire electrical conductors, then the effective length of the leaf springs must be dimensioned appropriately larger. However, due to the greater length of the leaf springs, a greater distance results between the guide-member leg and the contact leg of the conductive core piece with the consequence that the material requirement for punching out and shaping the conductive core piece is correspondingly greater.

This is a disadvantage, since the material from which the conductive core piece is to be produced must be a good current conductor and is relatively expensive. Also, in current conductors of this type, we are dealing with a mass-produced product, and any increased requirement for expensive material considerably increases the total production costs.

The task of the invention is to create a clamping connector of the above-named type, which makes possible the use of softer (longer) leaf springs without increasing the material consumption for the conductive core piece thereby.

In the clamping connector of the invention, the large loop part of the leaf spring is the determining factor for the desired soft spring characteristic. The loop part extends in a direction opposite the direction of conductor introduction and utilizes the free space of the construction inside the insulation-material housing of the clamping connector, which is present in connectors of this type due to the structural constriction of the channel of conductor introduction in order to form a point-precise inlet hopper for the clamping site.

The looped leaf spring is mounted with its head part in the guide-member leg, which is connected directly to the contact leg of the corner angle at the point of the corner-angle construction of the conductive core piece. According to the invention, if the foot end of the leaf spring forms with the contact leg a clamping place next to the point of the corner angle (which is possible in the contact insert according to the invention without adversely affecting the desired spring characteristic), then the guide-member leg of the corner-angle conductive core is essentially loaded in a pulling manner by the clamping forces of the leaf spring. Undesired bending moments do not occur on the guide-member leg, so that the strength of the guide-member leg must be calculated only relative to tensile strength, whereby there can be a corresponding savings of material with the constructive dimensioning of the guide-member leg.

This applies also to the constructive dimensioning of the contact leg of the corner-angle conductive core. With this feature (arrangement of the clamping site in the vicinity of the corner point), the latter also need not absorb noteworthy bending moments and remains free overall of mechanical loads of all types (=no bending forces, no pulling forces). The contact leg essentially serves only for current conduction and thus may be optimized in its cross-sectional dimensions exclusively from the point of view of a sufficient cross section for conducting current. This also saves material.

BRIEF DESCRIPTION OF THE DRAWINGS

Examples of embodiment of the invention will be described below in more detail on the basis of drawings. Here.

DETAILED DESCRIPTION

Figure 1:
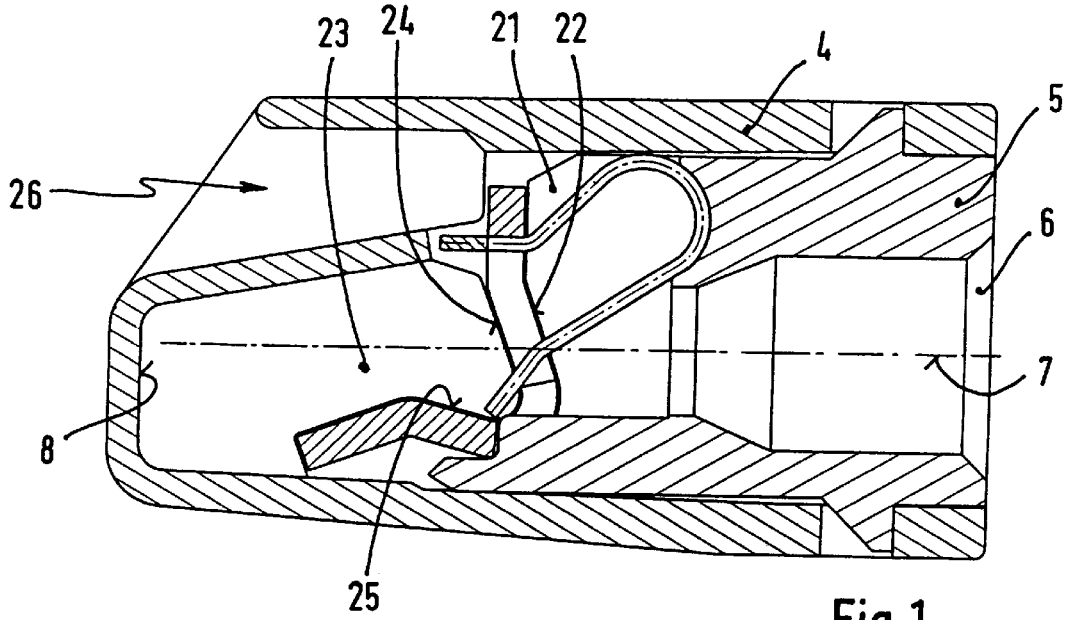
FIG. 1 shows a cross section through a connector according to the invention.

FIG. 1 shows a connector with an insulation-material housing 4, which is closed by an insulation-material cover 5 on the front side. Several openings 6 are present in a row next to one another in the insulation-material cover (see also FIG. 3 for this). Each opening for introducing a conductor is the beginning of a conductor-introduction channel, which extends through the entire insulation-material housing (see the depicted central line 7 in FIG. 1 for this) and which with its blind-hole end 8 also forms an end stop for an inserted electrical conductor.

Figure 2:
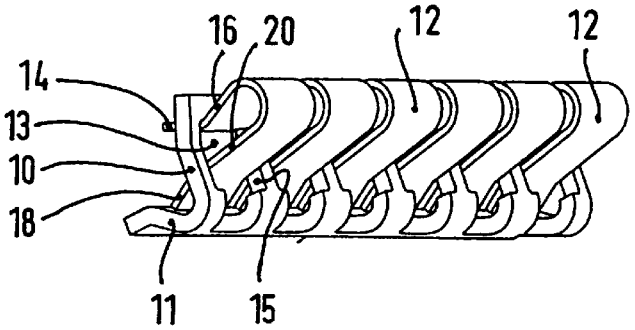
FIG. 2 shows in perspective representation the contact insert according to the invention.

A contact insert is arranged in the insulation-material housing, which is presented more precisely in FIG. 2. The contact insert comprises a conductive core piece with six leaf springs in all, which are mounted next to one another in a row and parallel to one another in the conductive core piece.

The conductive core piece has a cross-sectional profile in the form of a corner angle with a guide-member leg 10, which is connected at the point of the corner angle directly to contact leg 11 of the conductive core piece. This corner-angle conductive core is incorporated in the insulation-material housing of the connector (see FIG. 1 for this) in such a way that guide-member leg 10 is arranged crosswise to the direction of introduction of the conductor in the channel for introducing the conductor, and that contact leg 11 extends in the direction of conductor introduction.

A slot-shaped oblong opening 13 is present in guide-member leg 10 for each leaf spring 12, and the upper end of this slot serves for mounting head end 14 of the leaf spring and the central region of the slot along with its side edges 15 guides the leaf spring (in the function of a so-called eccentric displacement slot) and this slot has in its lower end the required passage for inserting an electrical conductor.

Each leaf spring 12 is shaped as a type of U-shaped open loop. Loop part 16 running out from head end 14 of the leaf spring extends counter to the direction of introduction of the conductor from the back of guide-member leg 10 and loop part 20 running back to foot end 18 of the leaf spring in the direction of conductor introduction extends through eccentric slot 13 of the corner-angle conductive core. Foot end 18 of the leaf spring has a clamping edge, which is directed opposite contact leg 11 of the corner-angle conductive core and together with this contact leg, forms a clamping site for the electrical conductor to be connected.

Leaf springs 12 are inserted into eccentric slot 13 of the corner-angle conductive core from the inside of the corner angle (i.e., the left side shown in FIG. 2). The mounting or the insertion of the leaf springs into the corner-angle conductive core can be conducted without problem and fully automatically, since head ends 14 of all leaf springs of a contact insert are connected together, i.e., when the leaf springs are stamped out, their head ends are not separated from one another, but remain joined together in the form of a head strip running over all leaf springs.

FIG. 1 shows the connector in the finished mounted state with the contact insertion according to FIG. 2. The insertion of the contact insert into insulation-material housing 4 of the connector is performed basically by means of an assembly opening on the front side, and this opening is then closed by insulating-material cover 5 also on the front side by pressing this cover in the direction of the conductor-introduction channel into the insulation-material housing.

This type of mounting is combined with a special configuration of separating walls, which separate the conductor-introduction channel of one clamping site from the conductor-introduction channel of the adjacent clamping sites, separately for each clamping site. The separating walls between the clamping sites are each formed of two parts, one of which, part 21, is injection-molded on insulating-material cover 5 and the other part 23 is injection-molded onto insulation-material housing 4. Thus, edge contour 22 of part 21 and edge contour 24 of part 23 are shaped in such a way that they tightly bound between them (near the edge) leg 10 of the corner-angle conductive core, passing crosswise in the conductor-introduction channel.

Edge contour 25 of housing-side part 23 on the bottom side of the separating wall lies tightly (near the edge) also on contact leg 11 of the corner-angle conductive core extending in the direction of the conductor-introduction channel, so that the conductor-introduction channel of one clamping site is nearly hermetically sealed relative to the conductor-introduction channel of the adjacent clamping site.

Like all connectors of this type, the connector shown in FIG. 1 also has a test opening 26 for testing the potential applied to the corner-angle conductive core.

Figure 3:
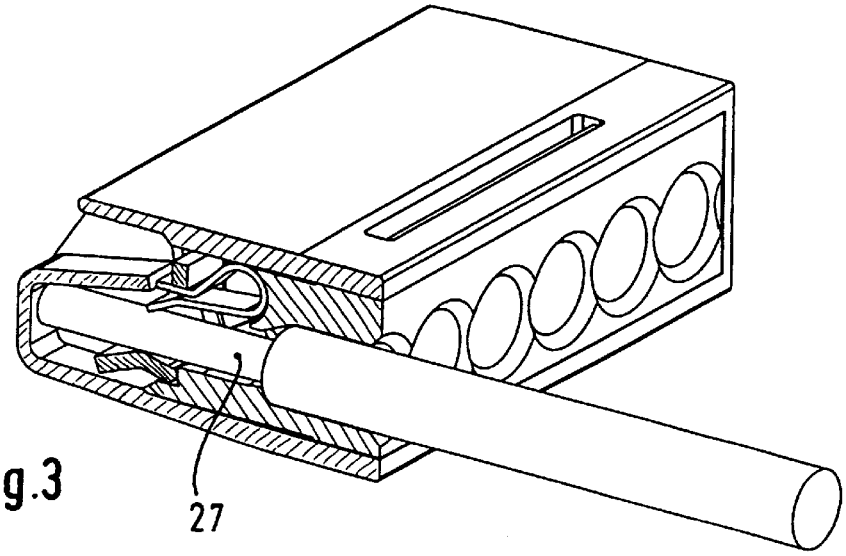
FIG. 3 shows the connector according to FIG. 1 with an inserted electrical conductor.

FIG. 3 shows in cutaway state the connector according to FIG. 1 with an inserted electrical conductor 27, which is a single-wire conductor in the case shown for reasons of simplification, but may be in practice also a multi-wire conductor, particularly a fine-wire conductor. While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. Self-clamping connectors for single-wire or multi-wire conductors, the connectors having a conductive core piece, which has a cross-sectional profile with a guide-member leg and a contact leg, a head end of one or more leaf springs arranged next to one another in a row is held on the guide-member leg, a foot end of each of these leaf springs has a clamping edge, which is directed against the contact leg of the conductive core piece and, together with this, forms a clamping site for an electrical conductor to be connected, wherein the cross-sectional profile of the conductive core piece is formed in the shape of a corner angle, comprising a guide-member leg, which leg is connected directly to a contact leg of the corner angle at the point of the corner angle, so that the guide-member leg and the contact leg are produced in one piece and form the corner angle in their totality, the corner angle is arranged in a clamping connector housing such that a back side of guide-member leg is arranged crosswise to a direction of conductor introduction and the contact leg is extended in the direction of conductor introduction, a slot-shaped oblong opening is present for each leaf spring in the guide-member leg and this opening is aligned perpendicular to a point of the corner angle and is formed by two side edges parallel to one another, and the distance between these edges is greater than the width of the respective leaf spring, each leaf spring is shaped in a type of U-shaped open loop with the head end and the foot end and is inserted in said opening such that:

the head end of the leaf spring is mounted in the upper end of the opening, a first loop part running out from the head end is extended out from the back of guide-member leg of the corner angle in the direction opposite to that of conductor introduction, and a second loop part running back to the foot end in the direction of conductor introduction forms with a conductor introduction channel a clamping-site inlet hopper, wherein the foot end of each leaf spring extends in the direction of conductor introduction through the opening and forms a clamping site with the contact leg of the corner angle.

2. The connector according to claim 1, wherein the clamping site is formed next to the point of the corner angle.

3. The connector according to claim 1, wherein stroke movements of the foot end of each leaf spring and a conductor passage through guide-member leg of the corner angle are guided in a fitted manner through side edges of the opening.

* * * * *